US008763421B2

(12) United States Patent
Friedmann et al.

(10) Patent No.: US 8,763,421 B2
(45) Date of Patent: Jul. 1, 2014

(54) DISPENSER UNIT FOR POSITIONING IN REFRIGERATOR DOORS OF DIFFERENT DESIGNS

(75) Inventors: Volker Friedmann, Biberach (DE); Georg Dorner, Steinhausen (DE); Holger Jendrusch, Rot an der Rot (DE)

(73) Assignee: Liebherr-Hausgeräte Ochsenhausen GmbH, Ochsenhausen (DE)

( * ) Notice: Subject to any disclaimer, the term of this patent is extended or adjusted under 35 U.S.C. 154(b) by 1137 days.

(21) Appl. No.: 12/220,724

(22) Filed: Jul. 28, 2008

(65) Prior Publication Data

US 2009/0031752 A1 Feb. 5, 2009

(30) Foreign Application Priority Data

Jul. 26, 2007 (DE) ..... 20 2007 010 401 U
Sep. 20, 2007 (DE) ..... 20 2007 013 169 U

(51) Int. Cl.
*F25D 3/00* (2006.01)

(52) U.S. Cl.
USPC ..... 62/389; 62/377; 312/405; 312/321.5; 222/146.6

(58) Field of Classification Search
CPC ..... F25D 23/028; F25D 2300/00; F25D 2323/02; F25C 5/005
USPC ..... 62/389, 340, 377; 312/401, 400, 405, 312/405.1, 321.5; 222/146.6
See application file for complete search history.

(56) References Cited

U.S. PATENT DOCUMENTS

2004/0183414 A1* 9/2004 Kwon ..... 312/401

FOREIGN PATENT DOCUMENTS

| | | |
|---|---|---|
| DE | 10 2004 013 432 | 10/2004 |
| DE | 600 17703 | 12/2005 |
| DE | 10 2005 057 161 | 5/2007 |
| WO | 2007/063039 | 6/2007 |

* cited by examiner

*Primary Examiner* — Cassey D Bauer
(74) *Attorney, Agent, or Firm* — Dilworth & Barrese, LLP.

(57) ABSTRACT

The present invention relates to a refrigerator unit and/or freezer unit having at least one door as well as having at least one output unit which is arranged in the door and by means of which goods, in particular ice and/or water can be output, with the output unit or a component for the reception of the output unit having a first section which is connectable to or in communication with a first design of a door and having a second section which is connectable to or in communication with a second design of a door.

20 Claims, 1 Drawing Sheet

DISPENSER UNIT FOR POSITIONING IN REFRIGERATOR DOORS OF DIFFERENT DESIGNS

BACKGROUND OF THE INVENTION

The invention relates to a refrigerator unit and/or freezer unit having at least one door as well as having at least one output unit which is arranged in the door and by means of which goods, in particular ice and/or water can be output.

Such output units serve to provide the user of the unit with, for example, ice cubes, crushed ice cubes, water, etc., without said user having to open the door of the unit for this purpose.

The output unit must be made such that it is matched to the door design such as e.g. to the door thickness, the door shape, etc., which has the result that different door designs require the use of correspondingly differently made output units.

SUMMARY OF THE INVENTION

It is therefore the underlying object of the present invention to further develop a refrigerator unit and/or freezer unit of the initially named kind such that different door designs can be used with a small effort.

This object is solved by a refrigerator unit and/or freezer unit having the features herein.

Provision is accordingly made for the output unit or a component for the reception of an output unit to have a first section which is connectable to or in communication with a first design of a door and to have a second section which is connectable to or in communication with a second design of a door. Such an embodiment of a refrigerator unit and/or freezer unit makes it possible for only one design of the output unit or of the component for the reception of the output unit to have to be manufactured and used for different designs of the door. It is, for example, conceivable to design the output unit or the component such that a planar door (hard-line door) and also a curved door (swing-design door) can be installed.

The named component can, for example, be a part which is foamed in the door and into which the output unit is inserted.

Provision can furthermore be made for the output unit or the component to have two or more than two sections which are each connectable to or in communication with two or more than two designs of a door. In this case, the output unit is not only usable for two different designs of the door, but optionally also for more than two different designs of the door.

The output unit or the component can have a housing or a frame, with the first section and the second section being arranged at the housing or at the frame. It is, for example, conceivable for the named component to be formed by such a housing or by such a frame and for the first section and the second section and, optionally, further sections for the fastening of different designs of doors to be arranged at the component.

Provision is preferably made for the output unit or the component to be foamed into the door. It is thus conceivable, for example, for a foamed-in part to be provided which forms the receiver for the output unit. The named sections which, in the inserted state of the foamed-in part or of the output unit, are in communication with the sections of the door which surround the cut-out in which the foamed-in part is arranged can be provided at this foamed-in part.

Provision is made in a further embodiment of the door for the first section and the second section in particular to be formed by areas which extend parallel or essentially parallel to the plane formed by the door.

The case is equally covered by the invention that at least one of the contact regions is made planar and at least one of the contact regions is made curved. In this way, the output unit or the component, which can as stated be made as a foamed-in part for example, can be made such that it can be used both for planar doors and for curved doors.

The first and the second sections can be arranged offset with respect to one another in the depth direction of the door. It is, for example, conceivable for the output unit or the named component to have a step in their marginal regions by which different support surfaces or support regions are formed.

Provision is made in a further embodiment of the invention for the output unit or the component to have securing means by means of which the output unit or the component can be fixed to the door. These securing means can, for example, be realized by projections which project from the output unit or the component and secure the door. These securing means can, for example, extend parallel to the plane of the door. It is also conceivable for the securing means to bound a groove or a gap between a contact surface and the securing means into which groove or gap the edge of the door bounding the cut-out of the door is inserted.

Provision is made in a further embodiment of the invention for different door thicknesses of pieces of furniture to be able to be balanced by a balancing part.

The balancing unit or the component can have a frame which encloses the output space and forms the front side of the output unit. This frame is, for example, placed on such that it covers the region at which the door covers the output unit or the component in an adjacent manner such that this region is no longer visible in the installed stage of the frame or of the strip.

To optimize the content of the output space, provision can be made for the output unit or the insulation boss to have an asymmetrical structure.

BRIEF DESCRIPTION OF THE DRAWINGS

Further details and advantages of the invention will be explained in more detail with reference to an embodiment shown in the drawing. There are shown.

DESCRIPTION OF THE PREFERRED EMBODIMENTS

Figure 1:
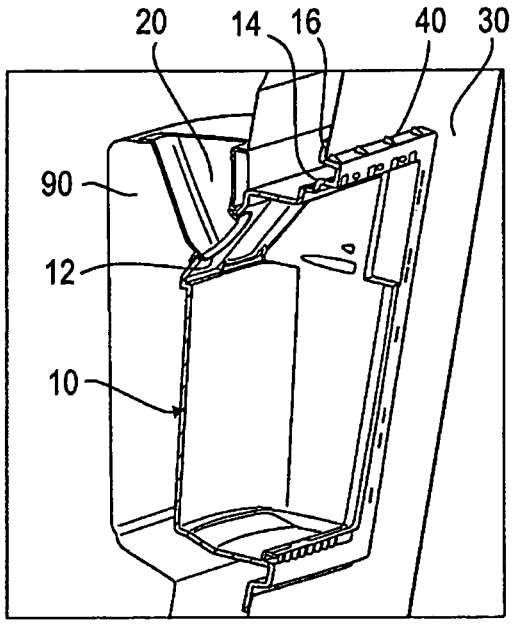
FIG. 1: a perspective representation of a component for the reception of an output unit having different reception regions for the installation of different door designs with a first door variant.

FIG. 1 shows the component 10 for the reception of an output unit in a perspective representation. The component 10 is a foamed-in part and is formed by a housing part open to the front. The foamed-in part 10 is foamed into the door and forms the reception for the output unit or for components of the output unit such as the mechanism as well as the electronics for the output of ice or water or the like.

The foamed-in part 10 has a cut-out 12 in its upper rear region through which ice or water or the like enter into the output space. For this purpose, a funnel-like component 20 is provided which is upwardly open and into which ice, water, etc. are introduced in the closed state of the door. The lower opening of the component 20 opens into the output space of the foamed-in part 10.

As can furthermore be seen from FIG. 1, the foamed-in part 10 has a step-shaped marginal region, with the step-shaped marginal region being made such that two webs or surfaces 14, 16 exist which form contact surfaces for different designs of doors. The contact surface of the web 16 is set back with respect to the contact 14 as can be seen from FIG. 1. Both the web 16 and the surface 14 extend vertically. In the embodiment shown in FIG. 1, the door 30 contacts the door web 16 in its marginal region bounding the cut-out. In this case, the door 30 is made as a so-called hard-line door, that is, as a planar door. The plane of the web 14 as well as the surface 16 are disposed in or parallel to the door plane.

Figure 2:
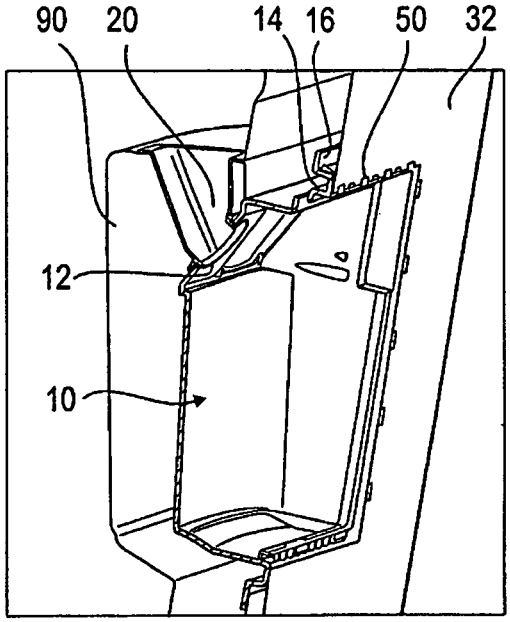
FIG. 2: the arrangement in accordance with FIG. 1 with a second door variant.

If the foamed-in part 10 should, however, be used for a curved door, as is shown in FIG. 2, this door 32 does not contact the web 16, but rather the surface 14 which is offset to the front with respect to the web 16. The door 32 is made in curved form and accordingly contacts the likewise curved surface 14.

As can thus be seen from FIGS. 1 and 2, in accordance with the invention, one and the same foamed-in part 10 can be used for different types of doors 30, 32. This variability does not necessarily have to be restricted to the shape of the door, but can, for example, also relate to the thickness of the door, etc.

For example, any door thickness of a piece of furniture (e.g. overlay/framed) can be balanced or covered by latching on a balancing part.

As can furthermore be seen from FIG. 1, securing means are provided in the form of projections 40 which have an edge which is spaced apart from the web 16 such that a spacing remains between the securing means 40 and the web 16 into which the door 30 is inserted in its region bounding the cut-out. The securing means 40 are made as elevated portions which extend over the plane which connects the web 16 to the surface 14. This plane can, for example, be made horizontal.

Securing means 50*o* are also provided for the state shown in FIG. 2, and indeed in the form of projections which extend substantially parallel to the plane of the door and which bound a space or a gap between the surface 14 and the securing means 50.

Figure 3:
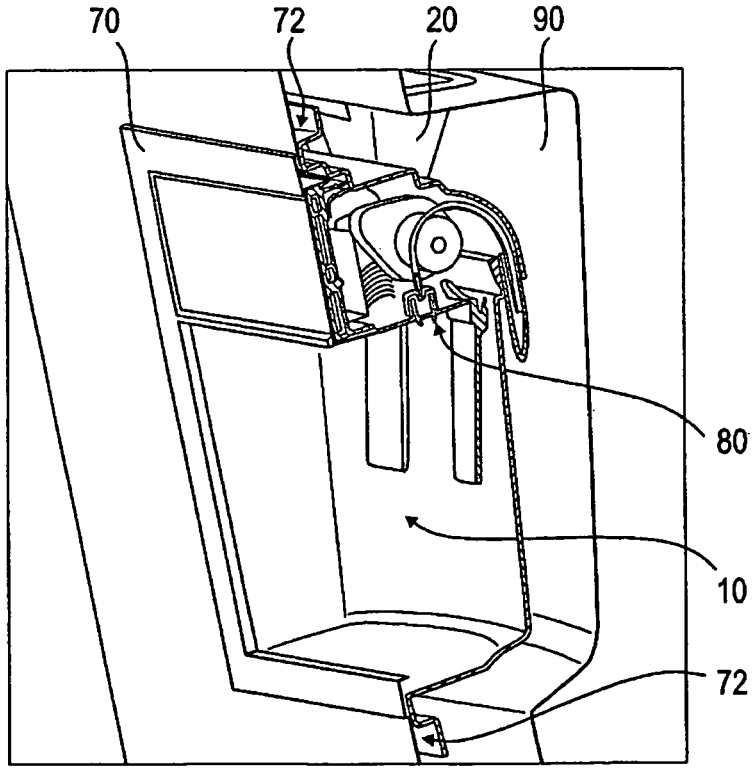
FIG. 3: an arrangement in accordance with FIG. 2 with an installed output unit in a side view.

FIG. 3 shows the arrangement in accordance with FIG. 2 with a complete output unit inserted into the foamed-in part 10. As can be seen from FIG. 3, the output unit has a display and/or an operating element by means of which the operator can control the output unit.

The output unit in accordance with FIG. 3 has a frame 70 which is placed onto the foamed-in part 10 from the front such that the transition between the foamed-in part 10 and the door 32 is no longer visible, but is rather covered by the frame 70. The step or the web 16 already visible from FIGS. 1 and 2 for the contact of the planar door in accordance with FIG. 1 can be seen with the reference numeral 72. A check valve is marked by the reference numeral 80 which is arranged in the output line for the dispensing of water.

The present invention thus has the advantage that the complete output unit can preferably be used identically in all installation situations. Different demands can thus be dealt with in different manners, irrespective of whether a minimal front frame structure or a stronger hard-line trim is desired.

To optimize the content, the insulation boss shown in FIGS. 1, 2, and 3 with the reference numeral 90 can be made asymmetrically. As can be seen from the Figures, the part 20 by means of which ice, water and the like moves from a corresponding output into the inner space of the output unit extends through the insulation boss.

The invention claimed is:

1. A refrigerator unit and/or freezer unit having at least one door, at least one output unit arranged in the door for outputting product, and a component (10) for receiving the output unit, wherein the output unit or component (10) for the reception of the output unit has a step-shaped marginal region including a first section (16) configured to contact and be connected to a door having a first shape, a second section (14) configured to contact and be connected a door having a second different shape from the first shape, and a third section attached to the top of the second section (14) and bottom of the first section (16) and being planar or angled in a different direction from said first and second sections (16, 14), such that said first and second sections (14, 16) are configured to contact and be connected to the respective doors separately and apart from one another to mount said output unit or said component (10) on the respective door through either the first (16) or second (14) section.

2. A refrigerator unit and/or freezer unit in accordance with claim 1, wherein the output unit or the component (10) has more than two sections which are each connectable to or in communication with door having its own distinct shape or design.

3. A refrigerator unit and/or freezer unit, in accordance with claim 2, wherein the output unit or the component (10) has a housing or a frame; and the first section (16) and the second section (14) are arranged at the housing or at the frame.

4. A refrigerator unit and/or freezer unit in accordance with claim 3, wherein the output unit or the component (10) is foamed into the door.

5. A refrigerator unit and/or freezer unit, in accordance with claim 1, wherein the output unit or the component (10) has a housing or frame; and the first section (16) and the second section (14) are arranged at the housing or frame.

6. A refrigerator unit and/or freezer unit in accordance with claim 1, wherein the output unit or the component (10) is foamed into the door.

7. A refrigerator unit and/or freezer unit in accordance with claim 2, wherein the output unit or the component (10) is foamed into the door.

8. A refrigerator unit and/or freezer unit in accordance with claim 1, wherein the first section (16) and the second section (14) are formed by contact regions which extend parallel or substantially parallel to the door.

9. A refrigerator unit and/or freezer unit in accordance with claim 8, wherein the contact regions extend parallel to one another.

10. A refrigerator unit and/or freezer unit in accordance with claim 8, wherein the contact regions are constituted by surfaces.

11. A refrigerator unit and/or freezer unit in accordance with claim 1, wherein the first section (16) and the second section (14) are arranged offset with respect to one another in the depth direction of the door.

12. A refrigerator unit and/or freezer unit in accordance with claim 1, wherein securing means (50) are provided by which the output unit or the component (10) can be fixed to the door.

13. A refrigerator unit and/or freezer unit in accordance with claim 1, wherein a balancing part is provided by which different door thicknesses can be balanced.

14. A refrigerator unit and/or freezer unit in accordance with claim 1, wherein the output unit or the component (10) has a reception space into which the goods are output.

15. A refrigerator unit and/or freezer unit in accordance with claim 14, wherein the output unit has a frame enclosing the output space and forming the front side of the output unit.

16. A refrigerator unit and/or freezer unit in accordance with claim 1, wherein the output unit has an asymmetrical structure.

17. A refrigerator unit and/or freezer unit in accordance with claim 1 in which the output unit is configured for outputting ice and/or water.

18. A refrigerator unit and/or freezer unit in accordance with claim 1, wherein contact surfaces of said first and second sections (14, 16) extend in the same direction.

19. A refrigerator unit and/or freezer unit having at least one door, at least one output unit arranged in the door for outputting product, and a component (10) for receiving the output unit, wherein the output unit or component (10) for the reception of the output unit has a step-shaped marginal region in turn having discrete sections (14, 16) adjacent one another, with a first section (16) configured to contact and be connected to a door having a first shape, a second section (14) configured to contact and be connected to a door having a second different shape from the first shape, and a third section attached to the top of the second section (14) and bottom of the first section (16) and being planar or angled in a different direction from said first and second sections (16, 14), such that said first and second sections (14, 16) are configured to contact and be connected to the respective doors separately and apart from one another to mount said output unit or said component (10) on the respective door through either the first (16) or second (14) section.

20. A refrigerator unit and/or freezer unit in accordance with claim 19, wherein contact surfaces of said first and second sections (14, 16) extend in the same direction.

* * * * *